US005295627A

United States Patent [19]

Wahba

[11] Patent Number: 5,295,627

[45] Date of Patent: Mar. 22, 1994

[54] FUEL INJECTOR STROKE CALIBRATION THROUGH DISSOLVING SHIM

[75] Inventor: Brent J. Wahba, Honeoye Falls, N.Y.

[73] Assignee: General Motors Corporation, Detroit, Mich.

[21] Appl. No.: 109,063

[22] Filed: Aug. 19, 1993

[51] Int. Cl.[5] ..... B05B 1/30; F02M 51/06

[52] U.S. Cl. ..... 239/585.4; 239/585.1; 251/129.18

[58] Field of Search ..... 239/585.1, 585.2, 585.3, 239/585.4, 585.5; 251/129.18, 129.21

[56] References Cited

U.S. PATENT DOCUMENTS 2,409,865 10/1946 Jewell ..... 285/22
4,509,693 4/1985 Nakai ..... 251/129.18
4,686,752 8/1987 Sharples ..... 29/163.5
4,946,107 8/1990 Hunt ..... 239/585.4
5,165,656 11/1992 Maier et al. ..... 239/585.4
5,232,167 8/1993 McCormick et al. ..... 251/129.21

*Primary Examiner*—Andres Kashnikow
*Assistant Examiner*—Christopher G. Trainor
*Attorney, Agent, or Firm*—Karl F. Barr, Jr.

[57] ABSTRACT

An electromagnetic fuel injector and novel method for assembly and calibration having a solenoid assembly with a pole piece, a valve assembly including an armature, and a working air gap separating the valve assembly from the pole piece when the injector is in a de-energized state. A shim having a thickness equivalent to the length of the working air gap is placed between the pole piece and the valve member during construction of the injector. Following assembly, a solvent is introduced into the injector to dissolve the shim, which is constructed of a material readily dissolvable in the desired solvent, to define the working air gap and, therefore, the static flow through the injector.

3 Claims, 2 Drawing Sheets

FUEL INJECTOR STROKE CALIBRATION THROUGH DISSOLVING SHIM

TECHNICAL FIELD

The invention relates to electromagnetic fuel injectors and, more particularly, to an injector and a method for static flow calibration utilizing a dissolving shim placed between the armature/valve and pole piece during assembly.

BACKGROUND

Electromagnetic fuel injectors are used in fuel injection systems for internal combustion engines to effectively control the discharge of fuel per unit time to the engine intake. Such electromagnetic fuel injectors are typically calibrated so as to inject a predetermined quantity of fuel per unit time prior to their installation in the fuel system.

Calibration of the fuel injector requires that both static and dynamic flow through the injector be precisely set and controlled. Typically, the static flow rate of such an injector is a function of the stroke of the valve assembly and is calibrated using a threaded spray tip. As the tip is rotated, the armature stroke, defined by the working air gap between the valve assembly and the solenoid pole piece, is increased or decreased. This method of adjustment is costly, and prone to thread damage and contamination which causes assembly difficulty. Additionally, as stroke is adjusted to accommodate static flow, the changing air gap length affects the magnetic circuit and therefore the dynamic flow rate of the injector.

SUMMARY OF THE INVENTION

Accordingly, a primary object of the present invention is to provide an improved electromagnetic fuel injector including features of construction, operation and arrangement, rendering it easy to manufacture, assemble and calibrate for a desired fuel flow, which is reliable in operation, and in other respects, suitable for use on production fuel systems for internal combustion engines.

The present invention provides an electromagnetic fuel injector having a housing with a solenoid assembly incorporated at one end thereof and an injection nozzle assembly incorporated at the opposite or discharge nd. A valve assembly is reciprocal, along an axis relative to a pole piece of the solenoid assembly and an associate valve seat of the nozzle assembly, to control fuel flow to the remaining elements of the injection nozzle. The injection nozzle assembly may further include an orifice director plate that is positioned at right angles to the injector axis and having an orifice located therein for directing discharged fuel in a predetermined spray pattern.

Movement or stroke of the valve assembly along the injector axis is determined by the gap between the end of the assembly and the working surface of the pole piece. The injector of the present invention is assembled with a precisely dimensioned polymer shim inserted between the end of the valve assembly and the pole piece working surface. The thickness of the shim determines the desired stroke of the valve. The spray tip is pressed in place until the valve assembly abuts the pole piece stop with the shim captured therebetween. The spray tip is welded in place, fixing the stroke of the valve assembly, and the injector is flushed with a suitable solvent to dissolve the shim and define the desired working air gap. The stroke tolerance is a function of the thickness tolerance of the shim only, resulting in tighter tolerances and lower cost of assembly.

For a better understanding of the invention, as well as other objects and features thereof, reference is had to the following description and to the drawings.

DESCRIPTION OF THE PREFERRED EMBODIMENT

Figure 1:
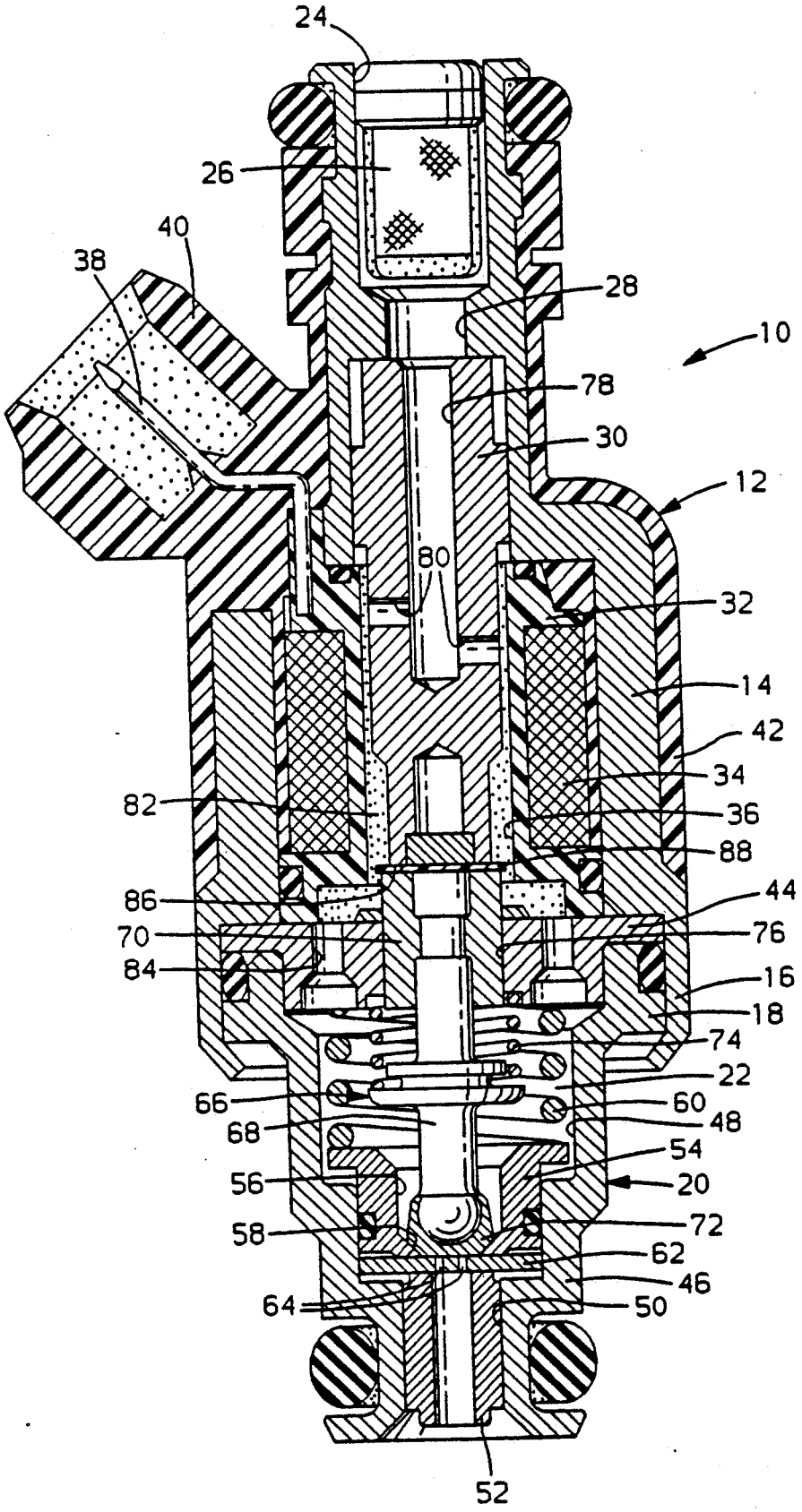
FIG. 1 is a longitudinal, cross-sectional view of an electromagnetic fuel injector incorporating features of the present invention.
Figure 2:
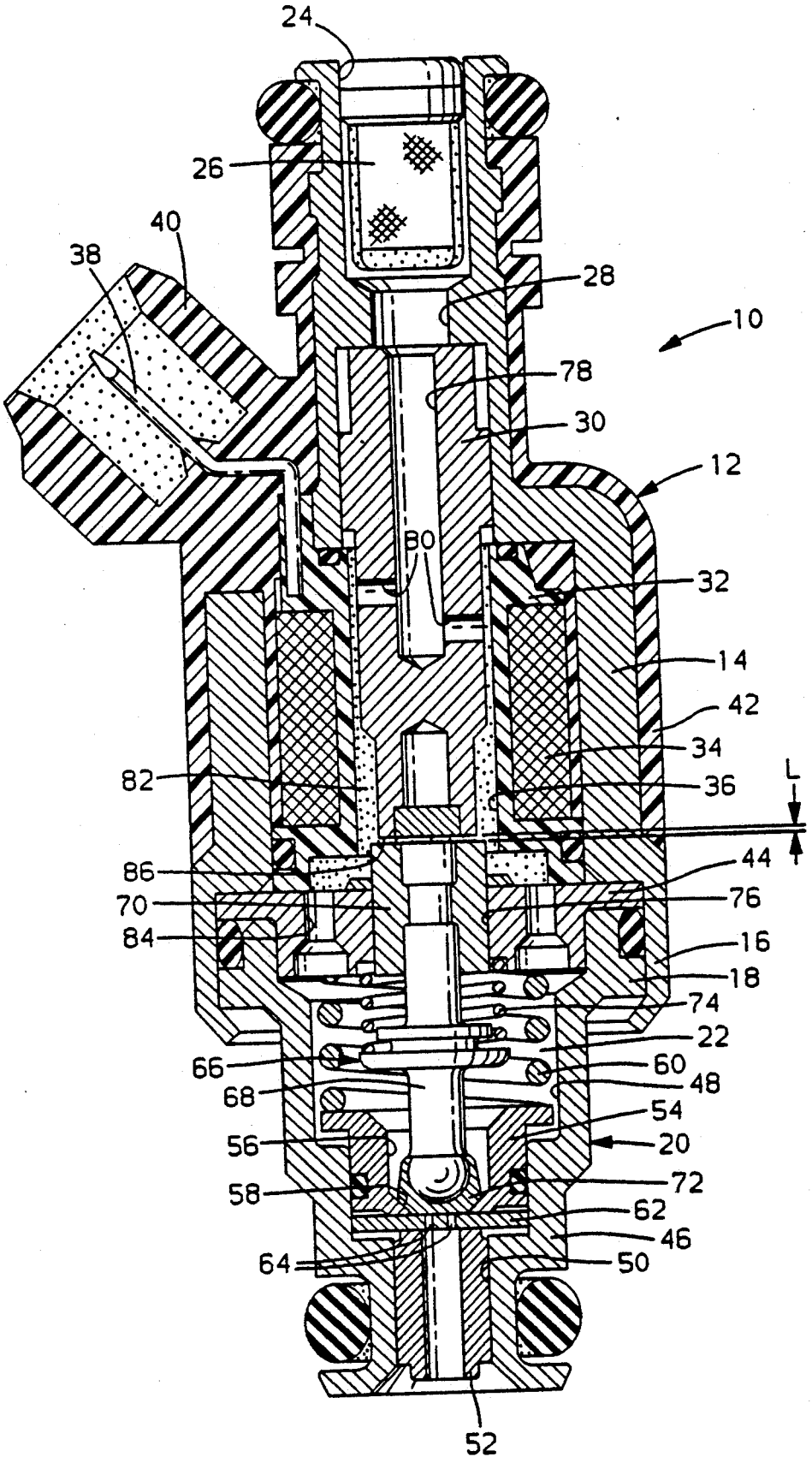
FIG. 2 is a longitudinal, cross-sectional view of the electromagnetic fuel injector of FIG. I following removal of the adjusting shim of the present invention.

FIGS. 1 and 2 illustrate an electromagnetic fuel injector, designated generally as 10, for supplying fuel to the intake manifold of an internal combustion engine, not shown. The fuel injector 10 is of a type similar to that disclosed in U.S. Pat. No. 4,699,323 entitled "Dual Spray Cone Electromagnetic Fuel Injector" issued Oct. 13, 1987 to Rush et al. and assigned to the assignee of the present invention. The injector has a solenoid assembly 12 with a generally cylindrical, stepped diameter body 14 having a skirt portion 16 at the lower end thereof, as viewed in the figures. The skirt portion 16 receives the shoulder portion 18 of nozzle assembly 20 which is fixed to the injector body 14, by inwardly crimping or swaging the skirt portion about the shoulder, defining fuel chamber 22 therebetween.

The body 14 of solenoid assembly 12 has a tubular inlet 24, in which a filter 26 is disposed, the inlet being adapted for connection to a source of pressurized fuel. A stepped bore 28 extends longitudinally from inlet 24 through the body 14 terminating in fuel chamber 22 and is adapted to receive the upper end portion of solenoid pole piece 30. A spool-like tubular bobbin 32 is located within an enlarged portion of stepped bore 28 and supports a wound wire solenoid coil 34 thereon. The bobbin 32 is provided with a centrally located through-bore 36 so as to loosely encircle the lower end portion of pole piece 30. A pair of terminal leads 38, only one being shown in the figures, are each operatively connected to the solenoid coil 34 at one end with a second end terminating in socket 40. The socket 40 is configured to be connected to a suitable controlled source of electrical power, in a well known manner and is formed as part of an encapsulant member 42 which is overmolded onto the solenoid assembly to provide a leak-free assembly.

A spacer disk 44 is located between the body 14 of solenoid assembly 12 and the nozzle assembly 20. The nozzle assembly 20 has a nozzle body 46 provided with a centrally extending stepped bore having an upper portion 48 which substantially defines fuel chamber 22 and a lower outlet portion 50 which receives a tubular spray tip 52 in sliding engagement therewith.

A valve body 54 adapted to be slidably received within the upper bore portion 48 of nozzle body 46 is also provided with a stepped axial through-bore 56 which terminates in a radially inwardly inclined wall which defines a valve seat 58. The valve body 54 is biased towards spray tip 52 by a coil spring 60, one end of which abuts against the valve body while the other end abuts against spacer disk 44. An orifice director plate 62 is positioned between the valve body 54 and tubular spray tip 52. The plate has fuel flow orifices 64 located therein which are configured to direct fuel exiting injector 10 through valve seat 58 in a desired fuel spray pattern.

Operatively mounted for longitudinal, reciprocal movement within fuel chamber 22 is an elongated valve assembly 66 which includes a valve element 68 and a tubular armature 70. The valve element 68 is constructed of stainless steel, ceramic, or other material having suitable durability. The lower end of valve element 68 has a valve head 72 which is biased into a normally seated position with respect to valve seat 58 by coil spring 74 and is adapted to be moved from such a seated position to define a passage for fuel to flow from fuel chamber 22 to tubular spray tip 52 for discharge from injector 10. Tubular armature 70 is suitably fixed to the upper portion of valve element 68 and has a diameter so as to be loosely slidable through a central aperture 76 provided in spacer disk 44.

Solenoid pole piece 30 has a bore 78 defining a fuel passage which, at one end, is in flow communication with fuel inlet 24 and which, at its other end, is in flow communication via radial inlet ports 80, with annular fuel cavity 82 formed by the diametrical clearance between the reduced diameter, lower end of the pole piece 30 and the solenoid bobbin 32. Annular fuel cavity 82 communicates with fuel chamber 22 through passages 84 in spacer disk 44.

Energization of the solenoid coil 34 draws valve assembly 66, against the biasing force of coil spring 74, from its position against valve seat 58 into engagement with the working surface 86 of pole piece 30. Valve lift and, thus, static fuel flow through injector 10, is a function of the length "L", FIG. 2, of the working air gap between the valve assembly 66 and the working surface 86 of pole piece 30. The present invention provides for the calibration of injector static flow during assembly of the injector by placing a calibration shim 88 shown in FIG. 1, having thickness equal to L, between the pole piece working surface 86 and the valve assembly 66. The tubular spray tip 52 is subsequently pressed into the nozzle body 46 until the valve assembly 66 is pressed against the working surface 86 of the pole piece 30 with the calibration shim 88 sandwiched therebetween. Upon bottoming of the valve assembly 66, against pole piece 30, the spray tip is welded or otherwise fixed in place in nozzle body 46 to retain the calibration L of the air gap defined by the shim 88, which remains in the injector 70 following assembly.

The calibration shim 88 is constructed of a material which is readily dissolvable in a solvent which is subsequently introduced into injector 10 through inlet 24. The particular shim material chosen is dependent upon the type of solvent chosen to flush the injector following assembly. A preferred shim material is polyvinyl alcohol, which is dissolved using a solvent such as water.

As indicated, following assembly of the injector 10, solvent is introduced through inlet 24 to dissolve shim 88, establishing the desired working air gap having a length L. The shim may be dissolved by filling the injector and allowing the unit to stand for a period of time sufficient to soften and dissolve the shim material or the injector may be cycled to induce a vibration, accelerating the dissolving process. The stroke tolerance of injector 10 is limited, as a result of the present invention, to the thickness tolerance of the calibration shim only, and can be maintained more closely and at a lower cost than other adjustment techniques which introduce significant tolerance stack-ups to the assembly.

The present invention discloses an electromagnetic fuel injector for use in an internal combustion engine having a novel method of construction which utilizes a shim, disposed between the armature assembly and the working surface of the solenoid pole piece to calibrate the working air gap length therebetween. The shim is constructed of a material which is readily dissolvable in a solvent which is introduced into the injector following assembly. Through removal of the shim, by dissolving in the solvent, the working air gap and, consequently, the injector static flow, is set without the introduction of calibration error from tolerance stack-up common with other types of injector calibration techniques.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and its practical application to thereby enable one of ordinary skill in the art to utilize the invention in various embodiments and with various modifications as are suited to the particular use contemplated. Therefore, the foregoing description is considered to be exemplary, rather than limiting, and the true scope of the invention is that described in the following claims.

The embodiments of the invention in which an exclusive property or privilege is claimed are defined as follows:

1. An electromagnetic fuel injector having a valve assembly moveable between open and closed positions with respect to a valve seat to establish fuel flow through said injector, a valve actuator comprising a solenoid assembly having a center pole piece with a working surface, and a shim disposed between said working surface and said valve assembly, and dissolvable by introduction of a solvent into said injector to define a working air gap between said valve assembly and said working surface.

2. An electromagnetic fuel injector, as defined in claim I, said shim constructed of a polymer material.

3. A method of calibrating an electromagnetic fuel injector comprising a valve assembly moveable between opened and closed positions with respect to a valve seat and an actuator comprising a solenoid assembly with a center pole piece having a working surface against which said valve assembly abuts in said opened position, said pole piece and said valve assembly separated by a working air gap when said valve assembly is in said closed position, comprising the steps of:

locating a calibration shim having a thickness of said working air gap between said pole piece and said valve assembly during injector assembly;

dissolving said calibration shim by introduction of a solvent into said injector to define said working air gap in said injector.

* * * * *